United States Patent [19]

Allard

[11] Patent Number: 5,013,902

[45] Date of Patent: May 7, 1991

[54] MICRODISCHARGE IMAGE CONVERTER

[76] Inventor: Edward F. Allard, 7830 Greeley Blvd., Springfield, Va. 22152

[21] Appl. No.: 395,596

[22] Filed: Aug. 18, 1989

[51] Int. Cl.[5] ..... H01J 31/50

[52] U.S. Cl. ..... 250/213 VT; 313/542

[58] Field of Search ..... 250/213 VT, 232, 207; 313/542, 544

[56] References Cited

U.S. PATENT DOCUMENTS

| | | | |
|---|---|---|---|
| 3,407,046 | 6/1968 | Schagen et al. | 313/544 |
| 3,783,299 | 1/1974 | Houston | 250/213 VT |
| 3,814,968 | 6/1974 | Nathanson et al. | 313/542 |
| 3,980,880 | 9/1976 | D'Agostino | 250/213 VT |
| 4,134,010 | 1/1979 | Eberhardt | 250/213 VT |
| 4,362,933 | 12/1982 | Kroener et al. | 250/213 VT |
| 4,837,631 | 6/1989 | Hicks, Jr. | 250/213 VT |

*Primary Examiner*—David C. Nelms
*Assistant Examiner*—Que Tan Le

[57] ABSTRACT

A proximity focused direct view, microdischarge electro-optical converter for converting a target scene into an enhanced visible image, whereby an optical target scene impinging on the input surface of a detector converts the photons of the optical scene into electrons, where upon an electrostatic lens focusses and enhances the resulting electron equivalent image onto a phosphor screen for effecting a direct view optically enhanced image.

11 Claims, 6 Drawing Sheets

MICRODISCHARGE IMAGE CONVERTER

BACKGROUND OF THE INVENTION

Prior Art

Many types of electro-optical devices are used to detect and image a scene. The scene radiates energy by self emission, as in the case of thermal radiation, or it can reflect radiation, as in the case of reflected sunlight, or it can radiate and reflect simultaneously. In any case, radiation in the form of photons or electro-magnetic radiation from a scene is directed to a lens which focuses the photons onto a detector or an array of detectors. The lens and detector are matched for the passband of radiation of interest and a system designed for operation in a particular part of the spectrum uses a detector that responds to photos in the same part of the spectrum. The early development of electro-optical systems has been concerned mainly with the detector and a means to read the detected signal. Television camera systems use photocathodes to capture scene photons and electronic beam scanning to read the photocathodes whereas image intensifier ($I^2$) systems use photocathodes and either electron-optics to accelerate the photoelectrons from the photocathode microchannel plates (MCP) to amplify the photoelectrons. Thermal imaging systems use photon or thermal detector which absorb thermal photons. Photon detectors absorb thermal photons and convert them into electron-hole pairs whereas thermal detectors absorb thermal photons and convert them into temperature changes in the detector. Thermal systems use various types of scanning schemes, such as electron-beam, mechanical or electronic scanning.

In principle, image intensifier systems are the simplest type of image converters as they do not require any type of scanning. Accordingly, they are referred to as direct view devices, which depend on photoelectrons from photocathodes to convert images. Photocathodes have limited spectral response characteristics and require an ambient light level to function. The subject invention provides for an extended spectral response for $I^2$ devices by using detectors that have extended spectral responses in lieu of the regular photocathode. Thus, the simplicity of an $I^2$ system may be applied to imaging systems that respond in various parts of the electromagnetic spectrum, but especially in the thermal infrared band.

The technology of cold cathode emission has been used for imaging purposes and uses tunnel electrons that tunnel through a metallic surface under the influence of a strong electric field. The electric field lowers the surface potential barrier of the metal allowing electrons to tunnel their way through the surface. The resulting current from the tunnel electron phenomenon depends on the metal's work function and the applied electric field with the tunnel current being highly non-linear. If an array of flat cold cathode electrodes be used for imaging purposes, the field and work function must be tightly controlled to prevent image non-uniformity or fixed pattern noise. In addition, since the cold cathode emission process is so non-linear, a very small change in the applied voltage produces a large change in the tunnel current which limits the usefulness of a cold cathode emission array from a contrast viewpoint, as small changes in contrast require microscopic changes in voltage which is extremely difficult to achieve.

SUMMARY OF THE INVENTION

The invention uses a new technique to read signals off a detector or a detector array.

Signals from an optical scene are converted into electrical signals and temporarily stored in a detector or an array of detectors. The electrical signals are pulled away from the detectors by an electric field. The pulled away signal is a microdischarge of electrons that are focused onto another surface. The second surface converts the electrons into another form of energy. The transfer of signal is a parallel processing technique that requires no scanning.

BRIEF DESCRIPTION OF THE DRAWINGS

FIG. 10*b* shows a readout device that can store microdischarged electrons on the screen itself.

DESCRIPTION OF THE PREFERRED EMBODIMENTS

Figure 1:
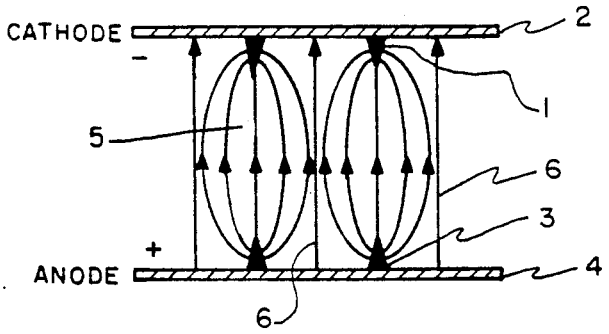
FIG. 1 shows microdischarge from a cathode to an anode.

This invention may perhaps be best understood by making reference to the several drawings. FIG. 1 shows an array of extended surfaces (1), in this instance two pins, but the array can be millions of pins extending in two directions. The array is attached to a cathode (2). Opposite the array (1) are other extended surfaces (3) attached to an anode (4). An electric field (5) is impressed between the cathode and anode. If the electric field is strong enough, tunnel electrons will be pulled away from the extended surfaces (1), called emitters. From electrostatics, the field at the tip of the emitters is higher than the field (6) between the emitters. Tunnel electrons from (1) will be focused onto the extended surface (3). If the extended surfaces (3) were removed, the tunnel electrons from (1) would still be focused in the neighborhood of (3). The extended surface (1) and (3) are part of an electrostatic lens that is used to focus the electrons from each emitter onto an area opposite it.

An expression for the tunnel current is given by:

$$J = \left(1.54 \times 10^{-6} \frac{F^2}{\phi}\right) \exp\left[-6.83 \times 10^7 \phi^{3/2} \frac{f(y)}{F}\right]$$

where $\phi$=surface work function

F=electric field f(y)=is a variable which takes into account the classical image force on the surface.

Temperature of emitters below 900° K. is not a factor. The tunnel electrons tunnel their way through the surface's (emitter surface) potential barrier due to the applied electric field. The field lowers the potential barrier. The potential barrier required for an electron to escape the surface is given by:

$$V_P = W - \frac{e^2}{4x} - eFx$$

where x is an electron's position outside the metal surface and $W=\phi+\epsilon$ and $\epsilon$=the fermi level of the metal.

When electrons receive this energy, they jump over the barrier. The term $e^2$ is associated with a classical image force.

Experimental data show that for a metal of work function 4.5, a field near $1.1\times10^7$ v/cm is required to generate a current of $10^{-12}$ amp/cm$^2$. A field of $10\times10^7$ v/cm calculates to a current of $6\times10^{-19}$ amp/cm$^2$. This non-linear effect renders cold cathode emission impractical for imaging purposes.

FIG. 2 shows an additional method for better focusing.

Figure 2A:
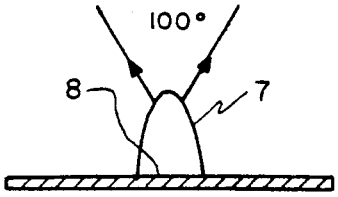
FIGS. 2*a*, 2*b* and 2*c* show electron discharge from various emitters.
Figure 2B:
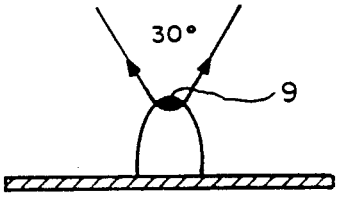
Figure 2C:
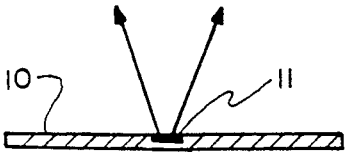

FIG. 2*a* shows a cone (7) which encloses an area where most of the tunnel electrons are emitted from the extended surface (8) with work function $\phi$. FIG. 2*b* shows that if a small ares (9) on the extended surface is changed to a lower work function, a more narrow cone of electron trajectories can be made. The 100° and 30° values are reported in the technical literature and they are given as an example. FIG. 2*c* shows a flat electrode (10) of work function $\phi_1$ with a small area (11) of work function $\phi_2$. Tunnel electrons will be pulled away from (11) before (10) for an increasing electric field. Focusing of electrons from the electrode (10) is improved by the addition of the area (11).

Figure 3:
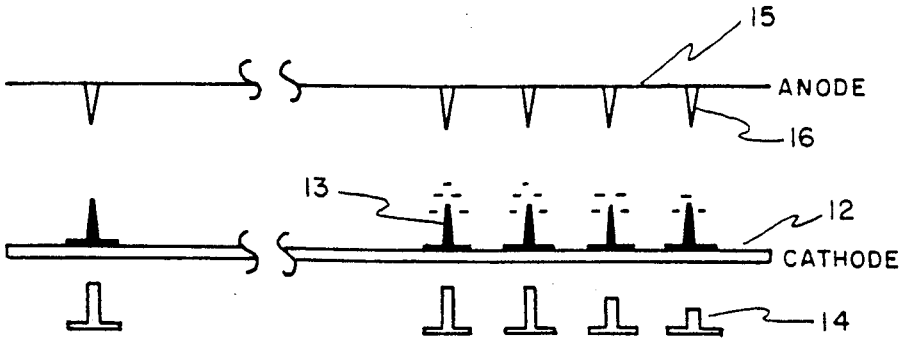
FIG. 3 shows a line of charged emitters set opposite a line of pin anodes.

FIG. 3 shows a cathode (12) with an array of emitters (13) that are electrically isolated. Electrical pulses (14) are used to charge the emitters (13). Opposite the cathode is an anode (15) with extended surfaces (16). The surface potential barrier of an emitter's surfaces is lowered by the induced charge on the emitter. Macroscopically by the Law of Gauss, all charge resides on the surface. Microscopically, the charge can be located on layers of the surface accompanied by shield effects. The form of the potential is given by:

$$V = W \frac{-e^2}{4x} - eFx - eS(\sigma)\sigma x$$

where $s(\sigma)$ is a shielding factor and $\sigma$ is the surface charge density Experimental data show that a field of only $10^4$ v/cm will totally discharge a charged sphere with $10^{10}$ electrons on it. If the electric field is increased to even $10^6$ v/cm, all electrons are discharged. The microdischarge is not sensitive to the field as long as the field is high enough to cause complete microdischarge. From the discussion of FIG. 1, it was seen that a field of $1.1\times10^7$ v/cm was required for tunnel electrons and that a small change in the field made a dramatic change in the current. In the microdischarge case, a large change in the field results in no change in the microdischarge. The same electric field is used to pull away all the charge from each electrode at the same time. This is a parallel signal transfer process.

Figure 4:
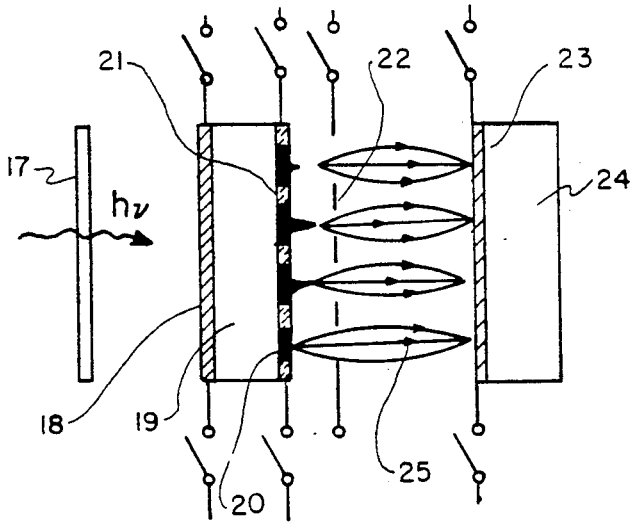
FIG. 4 shows a device that converts incoming radiation into electrons where the electrons are stored on pins and where the pins are connected by a material that can change its conductive state from an insulator to a conductor whereby when an electric field is applied the pins discharge to an anode.

FIG. 4 shows how microdischarge is used for image conversion in the case of a thermal detection system. Chopper (17) alternately allows radiation from a scene to fall on the front surface (18) of a detector (19). The front surface (18) serves many functions. In the case of a thermal detector it is an absorbing surface that absorbs thermal radiation. The absorbed radiation heats small areas of (18) in proportion to the focused image on (18). It also serves an an electrode for detector (19). Surface (18) can be a transparent electrode for other detectors. Emitters (20) are attached to detector (19) in an array. Only the side view is shown in the figure. A material (21) is connected to the emitters (20). This material can change its electrical state from insulator to conductor. Materials, such as CdSe, will change from an electrical conductor to an insulator or vice versa when an electric field is applied across the material. Conductive mesh (22) is used as one electrode to change material (21) from an insulator to a conductor. Front surface (18) is the other electrode. When a field from (22) to (18) is impressed on material (21), the material is switched from a insulative state to a conductive state. Where the field is switched off, the material switches back to its insulative state. Surface (23) is a thin film electrode, as found on various types of metallized phosphor screens (24). Pockets of electrons (25) are pulled away from the emitters (20) by a field used to pull away the electrons. It does not depend on the source of the electric field, or the position of the electrodes. The positions of electrodes in FIG. 4 are for a particular device. When the chopper (17) allows focused radiation to fall on absorbing electrode (18), small areas of the electrode change their temperature in proportion to the absorbed radiation. The change in temperature at the local areas, changes the temperature of the thermal detector at the same locations. Thermal detectors, such as pyroelectric materials, change their polarization when heated and release electrons that were used to neutralize the polarization before heating. These released electrons move to the tips of the emitters. When the chopper begins to close the windows, an electric field is impressed on electrode (23). This field pulls away the charges on the emitters by microdischarge. The pulled away electrons are accelerated across the gap, focused onto electrode (23) where they give up some of their energy, and are converted by phosphor (24) into photons. When the chopper blocks the radiation, the detector cools to the temperature of the chopper blade. For stable operation, the emitters (20) must be replenished with electrons before the chopper opens the window again. The replenishing process takes place when mesh (22) is energized to create a field across material (21). The material becomes conductive and connects all emitters to ground or to a predetermined voltage level. All emitters are replenished with electrons and set to the same voltage. Mesh (22) is then turned off and the detector is at an initial state when the chopper opens the window again. The device operates in a pulse gated mode where the gate is syncronized to the chopper. If the emitters are set to zero potential when they are stabilized to the chopper blade temperature, the device can only display scene temperatures above the chopper blade temperature. When the scene cools the detector below the chopper blade temperature, the emitters have a depletion of electrons, and microdischarge is zero. If the chopper blade is cooled, microdischarge can be used to display lower scene temperatures. Another way to detect lower scene temperature is to lower the initial voltage state of the detector. The emitters can be set at a voltage lower than zero which gives each electrode the same number of non-signal electrons. These electrons represent a D.C. signal level. Under this condition, microdischarge will contain signal and D.C. In this case, the chopper blade does not need to be cooled to detect lower scene temperature.

Figure 5:
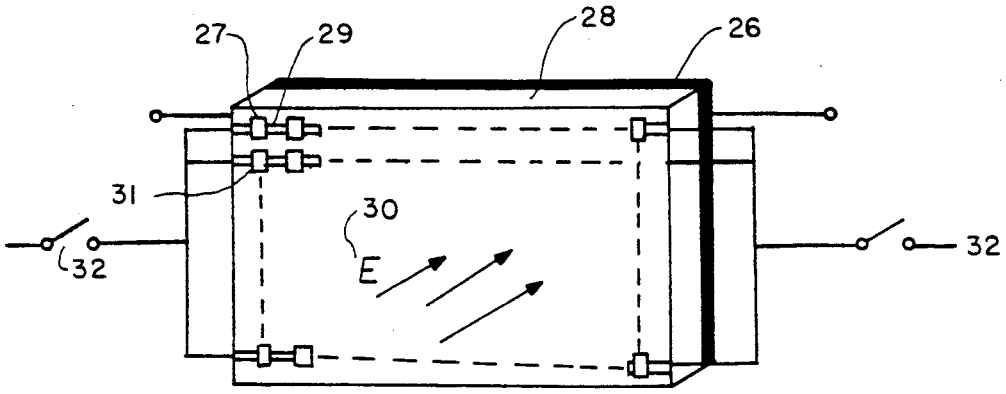
FIG. 5 shows a view of an array of isolated conductors connected by a material that can change its electric state from conductive to insulative by applying an electric field across the material.

FIG. 5 shows a two dimensional detector with a signal plane useful for microdischarge. Electrode (26) faces the incoming radiation. Electrodes (27) are attached to detector (28) in a two dimensional array and electrically separated from each other. Material (29) is an insulator that connects the electrodes and can be switched from an insulative state to a conductive state by applying an electric field (30). Switching the electric field off and on switches material (29) from insulative state to conductive state. An extended surface/emitter (31) is electrically connected to each electrode (27). The emitter (31) can have the same work function as (27) or have a different work function. In addition (31), can be flat with a different work function as described in FIG. 2. The electrical separation of electrodes (27) prevents conduction of electrons from one electrode to another when the material (29) is an insulator. This electrical state is used when each emitter is being charged with signal electrons. After microdischarge, the material (29) is switched to its conductive mode which allows electrons to flow through conductors (32) so that each emitter is set to an initial electrical state. After the replenishing process, the material (29) is switched to its insulative state and is ready for the open window of the chopper.

Figure 6:
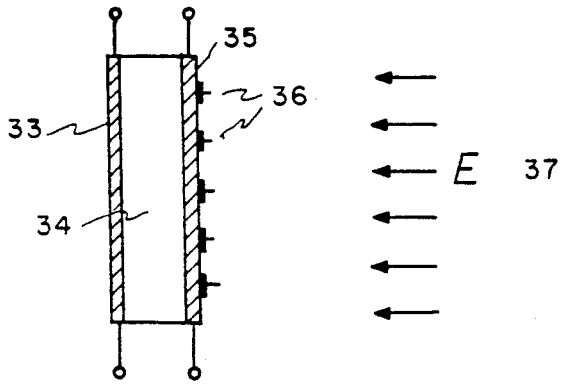
FIG. 6 shows a set of pins on a thin film material that can change its electrical state by applying an electric field across it.

FIG. 6 is another detector that can be discharged. Electrode (33) is one electrode for detector (34). A film of material (35) is attached to detector (34). Emitters (36) are attached to material (35). Material (35) has the same properties as material (29) of FIG. 5. When detector (34) is charging and material (35) is insulative, the charge will remain localized under the emitters. If a weak field E is turned on, the field will concentrate at the emitters. An electric field pulse charges material (35) momentarily to a conductor allowing the electrons under the electrodes to flow to the emitters where they are trapped when the field is turned off. The trapped electrons are pulled away by applying a stronger field required for microdischarge.

Figure 7:
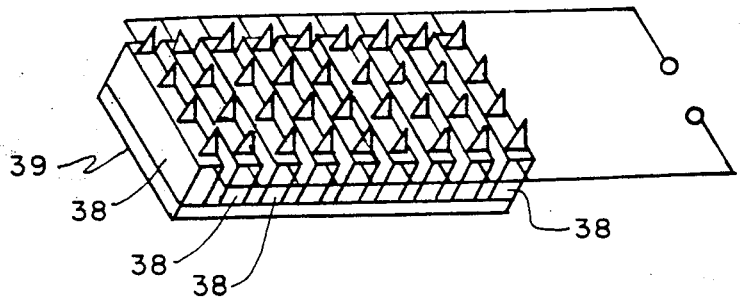
FIG. 7 shows a detector array where the rows have grooves between them in order to reduce heat transfer.

FIG. 7 is another detector that can be discharged. The detectors (38) are physically separated row from row. This separation prevents heat transfer from row to row and any electrical transfer from row to row. Each emitter is connected by a switchable material (39) with the same properties as material (29) of FIG. 5.

Figure 8:
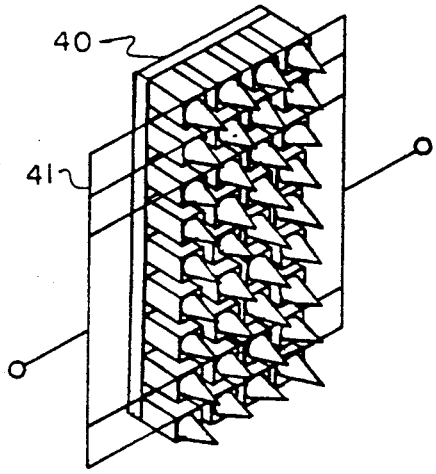
FIG. 8 shows a detector array where each detector element has grooves around it in order to reduce heat transfer and the elements are connected by a semiconductor wire.

FIG. 8 is another detector that is physically separated in two directions. The physical separation prevents heat transfer in the horizontal and vertical direction. The replenishing process can be achieved by connecting each electrode in a line with compound/semiconductor line (41).

Figure 9:
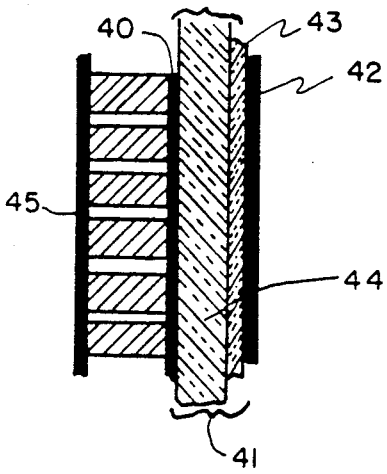
FIG. 9 is an end view of FIG. 8 which shows more detail of the semi-conductor wire which connects the elements of FIG. 8.

The compound line is shown in FIG. 9. In FIG. 9, electrode (40) is the same as (40) in FIG. 8. Semiconductor line (41) is the same (41) in FIG. 8. Electrode (42) is attached to insulator (43) which is interfaced to material (44). Material (44) can be switched from an insulator to a conductor and vice versa by applying a field between electrode (42) and electrode (45). Insulator (ferroelectric material, for example) (43) serves as an interface to (44) which is required for the switching process. Since line (41) can be a few microns thick, there is little heat transfer through the line from electrode to electrode. The line can be made circular with the conductor in the center and covered by insulator (43). This insulated conductor can be coated with a suitable material (44) and attached to the electrodes (40). The electrode (42) replaces the wire mesh (22) of FIG. 4.

Figure 10A:
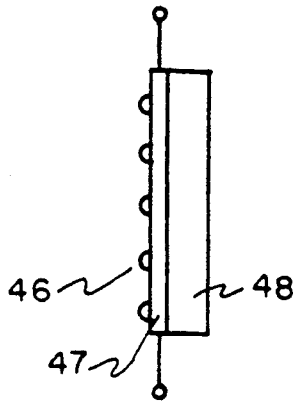
FIGS. 10*a* and 10*b* show a receiving screen whereby the screen is an array of extended surfaces that help focus microdischarge electrons to a smaller area on the screen.
Figure 10B:
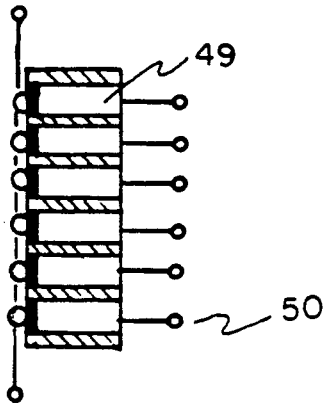

FIG. 10 shows a one dimensional view of a two dimensional screen. The screen is used as part of a microlens for focusing the pulled away electrons from the emitters. FIG. 10*a* shows an array (46) of extended surfaces as a conductive electrode (47). When a voltage is applied to (47), an electric field is created between (47) and the electrode (18) of FIG. 4. The electric field is stronger on the extended surfaces than on the flat surface of (47). This stronger field forces the pulled away electrons from an opposite emitter to focus near their opposite extended surfaces, which improves the resolution of the transferred image. A phosphor (48) converts the electrons into photons. FIG. 10*a* has the same extended surfaces as 10*b*. The phosphor (48) is replaced with an array of electrically isolated storage elements (49). Electrons are stored in the elements (49), such as a CCD device, where they can be read out at output terminal (50) by one of several read out mechanisms. The storage elements provide a convenient means to store the image in the form of electrons. By using appropriate addressing techniques any one element can be read out for processing. A digital image could be generated.

Referring back to FIG. 4, the emitters (20) are charged with electrons. The emitters themselves are part of a microlens for focusing the pulled away electrons. FIG. 4 shows a proximity focused device where the pulled away electrons are accelerated across a gap to strike an anode (23). The pulled away electrons can be focused by other means. An inverter image intensifier tube focuses photoelectrons from a photocathode by an electrostatic lens. Another version of the same device uses a microchannel plate (MCP) inside the tube to amplify the pulled away electrons. Still another device uses an MCP between the photocathode and phosphor, all three proximity focused. The array of emitters (20) of FIG. 4 can replace the photocathodes of the various image intensifier tubes, allowing the image intensifiers to respond to any wavelength that the detector (19) responds to. If a pyroelectric detector is used, it generates a signal only for a change in temperature. It is an A.C. coupled system which avoids the problem of detecting a small A.C. signal on a large D.C. signal. Pyroelectric detectors have a flat response across most of the optical spectrum so they have a variety of applications. Other detectors such as PbS respond in various parts of the spectrum, depending on the cooling of the detector. The cooling of detectors changes their spectral response and their sensitivity. The detector (19) of FIG. 4 can be cooled by standard techniques, so a variety of detectors can be used.

One of the major problems of imaging with thermal photon detectors is the large D.C. signal due to background and the small A.C. signal from a target. A detector's electronics of present thermal imaging systems amplifies the detector's signal and capacitively blocks out the D.C. signal. Microdischarge techniques do not allow for A.C. coupling unless the D.C. is subtracted out by another technique. FIG. 10*a* shows an electron storage device. This device can be used to subtract out a thermal D.C. level when used in conjunction with a chopper. Referring to FIG. 4, a detector (19) that responds to total radiation falling on it will charge the electrodes (20). This charge could be D.C. and signal. When the screen (23) and (24) are replaced by the electron storage array of FIG. 10*a*, the pulled away electrons are stored. The storage array could be a Charged Couple Device (CCD). The stored electrons are read out by standard techniques. When the chopper closes the window detector (19) with an appropriately designed electrode (18), it sees the temperature of the back side of the chopper's blade. storage array. When this D.C. signal is read out by CCD read out techniques, it can be subtracted element by element from the signal plus D.C. of the previous signal. The advantages of using a chopper with microdischarge and with an electron storage screen are that an expensive scanner, used with thermal imaging systems, can be eliminated and the video electronics associated with the detectors can be eliminated. The system can use any detector that provides electrons for the emitters.

Figure 11:
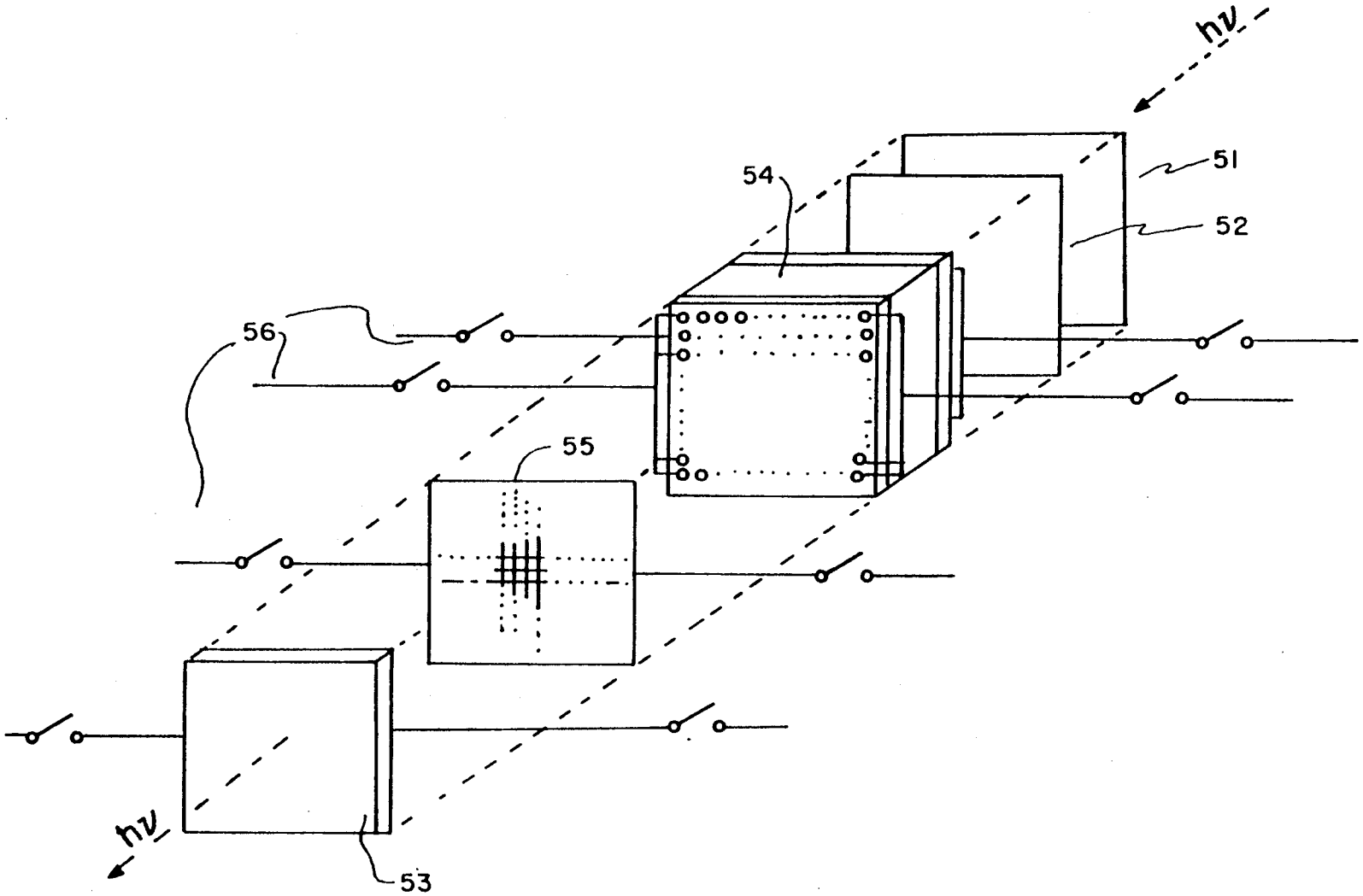
FIG. 11 shows the major components of a practical device where photons are converted to electrons whereby by microdischarge the electrons are amplified and focused onto a phosphor screen where they are converted into visible photons.

FIG. 11 shows the major components of a practical device. Chopper blade (51) is outside the vacuum tube whose front surface is window (52), which allows radiation to pass through it, and a back surface (53) which converts electrons into photons. This back surface can be replaced with other surfaces, such as a CCD array, without affecting the operation. Surface (54) is a detector as previously described, for example, the detector in FIG. 5. A mesh (55) is used to switch the detector as previously described. Several electrodes (56) are shown as switches. These electrodes are energized by controlling electronics (not shown) outside the vacuum tube. The controlling electronics applies the appropriate pulse gated signals to operate the device, as previously described. The detector and mesh are contained in the vacuum tube. There can be variations on the same design. As previously described, the mesh (55) can be replaced by a mesh on the detector as described in FIG. 9. A microchannel plate (MCP) can be included in the vacuum tube to provide amplification for the pulled away electrons. It would be located between screen (53) and mesh (55). The design of FIG. 11 can be called a proximity focused system. The emitters on the detector are set at an appropriate distance from the screen (53) so that microfocusing provides the desired resolution. When an MCP is used for amplification, the detector is proximity focused to one side of the MCP while the other side is proximity focused to screen (53). The device operates properly as long as the pulled away electrons are focused on a receiving surface. The receiving surface can be located at a remote distance as long as an electro-magnetic lens is used to focus the pulled away electrons. An inverter image intensifier can be converted into an inverter thermal intensifier.

Figure 12:
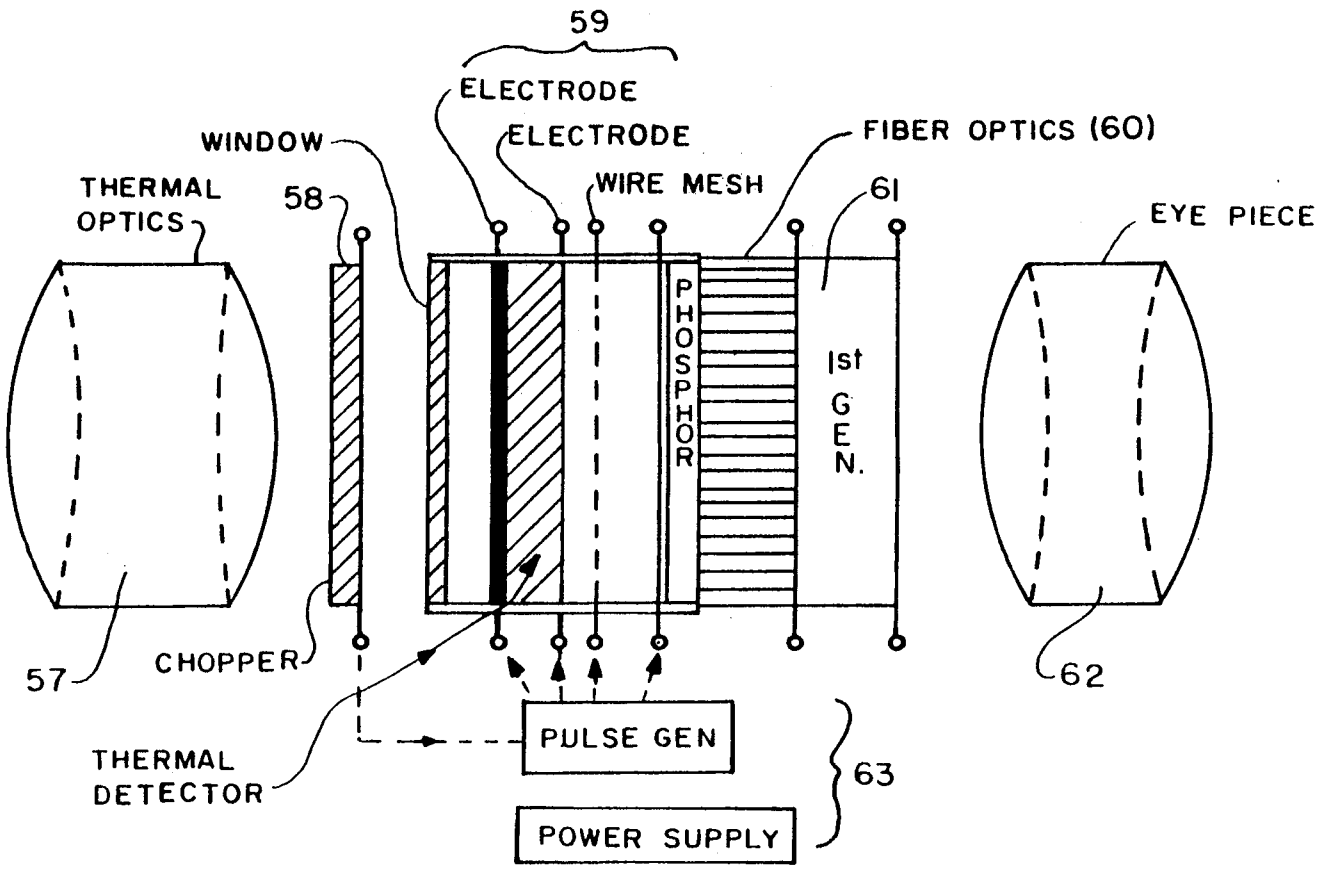
FIG. 12 shows a practical device consisting of an objective lens, a chopper, a microdischarge image converter, a light amplifier and an eyepiece.

FIG. 12 shows a device that uses optics (57), a chopper (58), a microdischarge unit (59), a fiber optic coupler (60), a 1st generation image intensifier (61), an eyepiece (62), and controlling voltage supplies (63). Radiation is focused onto the front electrode of (59) whereby the detector converts this radiation into electrons, whereby these electrons are attracted to an array of pin electrodes. These charged pins are discharged simultaneously by an electric field whereby the electrons are accelerated across a gap, focused, and strike the phosphor. The phosphor presents an image to a light amplifier (61). The light amplifier presents a bright image to the eyepiece. The associated electronics supply the necessary electric fields to discharge the pin electrodes, resupply the electrodes with electrons and supply the required gating signals. Several other configurations can be constructed to achieve the conversion of scene radiation to a useable image.

I claim:

1. A proximity focused direct view, electro-optical converter for converting a target scene lying within the visible to far infrared region of the electro-magnetic spectrum into an enhanced visible image, comprising:

photon detector means having input and output surfaces responsive to a preselected band of frequencies;

means for focusing a photon image of a target scene onto the input surface of said detector, whereby the photons excite said detector to generate and store charge carriers commensurate with the intensity and location of photons falling upon the input surface;

means for generating an electric field;

an electron to photon converter means, whereby said electric field generating means causes a discharge of said charge carriers from the output surface of said detector, in the form of electrons, which are focused onto and strike said electron to photon converter means for effecting thereon an enhanced image of the target scene.

2. The apparatus of claim 1, further including a chopper means for periodically interrupting the flow of photons from the target scene at a prescribed frequency in order to allow the photon detector to properly discharge the accumulated charge carriers, whereby the detector may be again exposed to the scene for recharging the dectector means and repeating the operation.

3. The apparatus of claim 2, wherein said photon detector means includes a layer of material particularly responsive to the specific frequency of the electro-magnetic spectrum desired and a layer of electron emissive material on the output surface of said detector for effecting the transfer of electrons from the detector to the electron to photon converter means.

4. The apparatus of claim 3, wherein said electron emissive material consists of isolated portions of the emissive material to provide better transfer of said electrons to said electron to photon converter means.

5. The apparatus of claim 4, wherein the isolated portion of emissive material form individual electron emitter and are isolated by a material which readily changes its electrical state from an insulator to a conductor upon the application of an electric field, whereupon electrons are released from the surface of the electron emitters as the chopper cuts off the flow of photons falling on the input surface of the photon detector and an electric field is impressed across the electron emitters, whereby the released electrons are accelerated toward the electron to photon converter means for providing an enhanced high resolution image thereon.

6. The apparatus of claim 5, wherein said electron emitters are configured as pin electrodes, whereby the charge thereon is concentrated near the tip of the pin for effecting a higher concentration of electron flow to the portion of said electron to photon converter having the closest proximity to the tip of the electron emissive pin.

7. The apparatus of claim 6, wherein said electric field generating means comprises a conductive mesh, which, when energized, creates a field across the emitter isolating material to render the material conductive, thereby connecting the emitters to a predetermined biasing level, whereupon the mesh is de-energized allowing the isolating material to revert back to its insulative state, whereby the detector may be again charged to repeat the cycle.

8. An electrostatic lens in a controllable electric field environment comprising a cathode and an anode spaced in a parallel relationship.

said cathode having input and output surfaces whereupon the input surface is sensitive to an applied electron charge constituting a varying charge density pattern along the surface of the material in accordance with the varying intensity of a representatively applied image with the output surface including a multiple array of electronically isolated emitters for storing the charge carriers commensurate with the intensity and location across the input surface of the electron image imposed on the input surface of the cathode;

said anode being placed in close proximity to said cathode such that upon the application of an electric field the stored charge carriers are caused to microdischarge and generate a like charge of varying intensity on the anode, thus focusing and enhancing the charge impinging on the input surface of the cathode.

9. The electrostatic lens of claim 8, wherein the multiple array of electronically isolated emitters comprise extended surface areas upon which charge carriers are continuously stored on the point of the extended surface areas until microdischarged by the application of an electric field sufficient to pull the charge off the tips for effecting a transfer of the charge pattern to the anode.

10. The electrostatic lens of claim 9, wherein the electric field applied to the cathode is of a magnitude of the order of $10^4$ to $10^6$ c/cm.

11. The electrostatic lens of claim 10, wherein the surface of the anode parallel to the cathode contains a like number of extended surface areas, whereby upon discharge of the stored charges from the output surface of the cathode, the charge is transferred to like positioned extended surfaces on the anode to effect an enhanced and more focused image on the anode than was applied to the input surface of the cathode.

* * * * *